US007171140B2

(12) United States Patent
Mizushima et al.

(10) Patent No.: US 7,171,140 B2
(45) Date of Patent: Jan. 30, 2007

(54) IMAGE FORMING APPARATUS

(75) Inventors: Nobuyuki Mizushima, Nagano (JP); Shigeo Fujita, Nagano (JP); Kuniaki Tanaka, Nagano (JP); Hiroshi Miyazawa, Nagano (JP)

(73) Assignee: Seiko Epson Corporation, Tokyo (JP)

( * ) Notice: Subject to any disclaimer, the term of this patent is extended or adjusted under 35 U.S.C. 154(b) by 205 days.

(21) Appl. No.: 10/930,693

(22) Filed: Aug. 31, 2004

(65) Prior Publication Data

US 2005/0084294 A1 Apr. 21, 2005

(30) Foreign Application Priority Data

Sep. 1, 2003 (JP) ..... P. 2003-308280
Sep. 1, 2003 (JP) ..... P. 2003-308281

(51) Int. Cl.
*G03G 15/00* (2006.01)

(52) U.S. Cl. ..... 399/167; 399/162

(58) Field of Classification Search ..... 399/167, 399/162, 75, 302, 308
See application file for complete search history.

(56) References Cited

U.S. PATENT DOCUMENTS 6,188,858 B1 * 2/2001 Swapceinski et al. ..... 399/167
2001/0028812 A1 * 10/2001 Saitoh et al. ..... 399/167 X
2004/0184845 A1 * 9/2004 Mitamura et al. ..... 399/167 X

FOREIGN PATENT DOCUMENTS

| | | | |
|---|---|---|---|
| JP | 09-160435 | | 6/1997 |
| JP | 2000-056620 | | 2/2000 |
| JP | 2000-098746 A | * | 4/2000 |
| JP | 2000-162901 | | 6/2000 |
| JP | 2001-343843 | | 12/2001 |
| JP | 2002-250400 | | 9/2002 |
| JP | 2002-287461 | | 10/2002 |
| JP | 2003-005511 | | 1/2003 |
| JP | 2004-077942 A | * | 3/2004 |

* cited by examiner

*Primary Examiner*—Sophia S. Chen
(74) *Attorney, Agent, or Firm*—Hogan & Hartson LLP

(57) ABSTRACT

An image forming apparatus, includes an image bearing member having an endless belt shape, on which a toner image is formed, and the image bearing member, a drive roller, which rotates the image bearing member laid around the drive roller, a drive gear, which is connected to the drive roller, and a drive transmitting gear, which is engaged with the drive gear, and transmits a driving force to the drive gear to rotate the image bearing member. The drive transmitting gear is arranged so that a direction of a drive reaction force of the drive transmitting gear with respect to the drive gear substantially coincides with an ingress direction of the image bearing member toward the drive roller.

19 Claims, 7 Drawing Sheets

IMAGE FORMING APPARATUS

BACKGROUND OF THE INVENTION

The present invention relates to an image forming apparatus which includes a belt-shaped image bearing member unit that lays an image bearing member configured by an endless belt around a drive roller and a winding member to drive and rotate the image bearing member, and which forms a toner image on the image bearing member, and thereafter transfers the toner image onto a recording medium to form an image.

In the image forming apparatus, a charging device for charging a photoconductor uniformly in a rotary direction, an exposing device for forming an eletrosatc latent image on the photoconductor, a developing device for developing the electrostatic latent image, a transferring device which transfers a toner image on the photoconductor onto a transfer medium, and a cleaner which cleans a face of the photoconductor after transfer, are arranged around the periphery of the photoconductor serving to an image bearing member. The electrostatic latent image formed on the photoconductor by the exposing device is developed by the developing device thereby to form a toner image. The formed toner image is transferred onto the transfer medium thereby to form an image. After the toner image is transferred, the residual toner on the photoconductors is removed from the face of the photoconductor by the cleaner.

In case of a rotary development type full-color image forming apparatus which forms a full-color image, a rotary development device provided with respective developing units of yellow Y, magenta M, cyan C, and black K forms a toner image of each color on the photoconductor, the toner images of the respective colors are in order transferred onto an intermediate transfer medium for multi layer transfer. Therefore, a development cartridge of each toner is detachably mounted on a development rotary unit; and each time an electostatic latent image for each color is formed on the photoconductor, the development rotary unit is driven by a development color switching operation, and the corresponding development cartridge is rotated and moved to the development position thereby to perform the developing operation for example, refer to JP-A-2002-287461 and JP-A-2003-5511).

FIG. 5 is a diagram showing outlines of the constitution of the full-color image forming apparatus. In the full-color image forming apparatus, as shown in FIG. 5, respective developing units 22Y, 22M, 22C, and 22K of yellow Y, magenta M, cyan C, and black K are detachably mounted on a rotary development device 21. The belt-shaped image bearing member unit includes a drive roller 7, a driven roller 8, a tension roller 16, and an endless belt. Further, the image bearing member unit includes an intermediate transfer belt 3 laid around the rollers 7, 8 and 16, and rotation-transferred in a direction of an arrow, on which a toner image on a photoconductor 20 is transferred; a first bias transfer roller 15 which is arranged on the back face of the intermediate transfer belt 3, opposed to the photoconductor 20, and transfers firstly the toner image on the photoconductor 20 onto the intermediate transfer belt 3; a cleaner blade 14 which removes residual toner on the intermediate transfer belt 3; and a second bias transfer roller 17 which is arranged opposed to the drive roller 7, and transfers secondarily a full-color toner image of four colors formed on the intermediate transfer belt 3 onto a recording medium (for example, a paper) 18.

In the image forming operation, selective exposure according to image data of a first color, for example, yellow Y is performed on the face of the photoconductor 20, and an electrostatic latent image of yellow Y is formed. At this time, the rotary development device 21 rotates and moves so that a development roller of the development cartridge 22Y of yellow Y comes into contact with the photoconductor 20, a toner image of the electrostatic latent image of yellow Y is formed on the photoconductor 20, and sequentially the toner image is transferred onto the intermediate transfer belt 3 by the first bias transfer roller 15 to which a first bias of an opposite polarity to the toner charged polarity has been applied.

For this time, the cleaner blade 14 and the second bias transfer roller 17 are separated from the intermediate transfer belt 3. This series of processing is repeatedly executed correspondingly to each image forming signal of a second color, third color, and a fourth color, whereby toner images of yellow Y, magenta M, cyan C, and black K according to contents of each image forming signal are in order transferred from the photoconductor 20 onto the intermediate transfer belt 3 in a multi layered manner thereby to form a full-color image of four colors.

Then, at a timing when the image formed by multilayer-transferring the toner images of the respective colors reaches the second bias transfer roller 17, the recording medium 18 in a sheet supply tray is transported from a pick up roller through a registration roller and a sheet material transporting path to the second bias transfer roller 17, the second bias transfer roller 17 is pressed on the intermediate transfer belt 3 and receives a second bias, and the toner image on the intermediate transfer belt 3 is transferred onto the recording medium 18 by the second bias transfer roller 17. The transfer medium on Which the toner has thus been transferred is transported to a fixing unit by a paper transporting unit, and the toner image on the recording medium 18 is heated and pressed by the fixing unit so that the toner image is fixed on the recording medium. The residual toner on the intermediate transfer belt 3 is scratched and removed by the cleaner blade 14 that has come into contact with the intermediate transfer belt 3.

FIG. 6 is a diagram for explaining drive reaction force and a sink phenomenon which act on a drive gear of the belt-shaped image bearing member unit, and FIG. 7 is a diagram for explaining an attachment structure of the belt-shaped image bearing member unit.

In the above related image forming apparatus, when the deaner blade 14 comes into contact with the intermediate transfer belt 3, a large load is rapidly applied onto the intermediate transfer belt 3, so that a drive transmitting gear 6 applies drive reaction force P onto the drive gear 5 as shown in FIG. 6. The belt-shaped image bearing member unit as shown in FIG. 7, is fixed, at its going part having four filing legs 2-1 to 2-4 (in FIG. 7, only the leg 2-1 is shown) which protrude from a unit frame 2, to a body frame 9 by locking screws 13. This fixing part is away from a supporting part which supports a bearing 4 for supporting a rotary shaft of the drive roller 7 and a drive gear on the unit frame 2.

Therefore, as shown in FIG. 6, when the drive transmitting gear 6 applies the drive reaction force P onto the drive gear 5, deformation (strain) is produced in the unit frame 2, and the drive gear 5 of the drive roller 7 for driving the intermediate transfer belt 3 sinks downward. Therefore, the drive power is not transmitted from the drive transmitting gear 6 on the image forming apparatus body side to the drive gear 5 on the belt-shaped image bearing member unit side, so that a problem that peripheral speed of the intermediate transfer belt becomes lower than that of the photoconductor 20 is caused. Since variation of the belt peripheral speed is caused lastly, a color registration error of the color transferred on the belt in a contact state of the cleaner blade 14 is caused with respect with a color transferred on the belt in a non-contact (separation) state of the cleaner blade 14. The registration error is produced in a direction where the belt lags behind (in a paper leading end direction).

For the purpose of eliminating such the disadvantage, in order to prevent a position shift of the drive roller in the drive reaction force direction due to the load of the separation and contact member, a reduction of the energizing force of the separation and contact member composed of the cleaner blade 14 or reinforcement of the unit frame 2 (formation using a hard material) has been performed. However, when the energizing force of the cleaner blade 14 is lowered to reduce the load, cleaning property on the intermediate transfer belt 3 lowers. Further, when the rigidity of the unit frame 2 increases to suppress the deformation of the unit frame 2, the weight of the unit frame 2 increases, which causes the increase of cost.

SUMMARY OF THE INVENTION

It is therefore an object of the present invention to provide an image forming apparatus which can enable to prevent the drive gear of the belt-shaped image bearing member unit from sinking in spite of the load variation thereby to prevent the variation of the speed of the belt, and to prevent deterioration of image quality by performing exact positioning in the up-and-down direction.

In order to achieve the above object, according to the present invention, there is provided an image forming apparatus, comprising:

an image bearing member, on which a toner image is formed, and the image bearing member having an endless belt shape;

a drive roller, which rotates the image bearing member laid around the drive roller;

a drive gear, which is connected to the drive roller; and a drive transmitting gear, which is engaged with the drive gear, and transmits a driving force to the drive gear to rotate the image bearing member, wherein the drive transmitting gear is arranged so that a direction of a drive reaction force of the drive transmitting gear with respect to the drive gear substantially coincides with an ingress direction of the image bearing member toward the drive roller.

According to the present invention, there is also provided an image forming apparatus, comprising;

an image bearing member, on which a toner image is formed, and the image bearing member having an endless belt shape;

a winding roller;

a drive roller, which rotates the image bearing member laid around the drive roller and the winding roller;

a drive gear, which is connected to the drive roller; and a drive transmitting gear, which is engaged with the drive gear, and transmits a driving force to the drive gear to rotate the image bearing member;

wherein the drive transmitting gear is arranged so that a line connecting axes of the drive transmitting gear and the drive gear is substantially perpendicular to a line connecting axes of the drive roller and the winding roller.

Preferably, the image forming apparatus further includes a cleaning member which is separatably abutted on the image bearing member to dean the image bearing member.

Preferably, the image forming apparatus further includes a positioning member which is abutted on a bearing portion of the drive gear for positioning the drive gear of the drive roller.

Preferably, the positioning member has at least one contact face opposed to the ingress direction of the image bearing member.

Preferably, the positioning member is a concave member having a bottom face and both side faces. The bearing portion is abutted on the bottom face and the both side faces when the bearing portion is fitted into the concave member. The concave member allows to detach the bearing portion therefrom upward.

Preferably, the positioning member fixes a rotary shaft of the drive transmitting gear to regulate a distance between the rotary shaft of the drive transmitting gear and a rotary shaft of the drive gear.

Preferably, an image bearing member unit is constructed by at least the image bearing member and the drive roller. The image bearing member unit further includes a plurality of fixing parts which are fixed to an image forming apparatus body frame. At least one fixing part dose to the connecting member of the drive gear in the fixing parts is fixed while energizing the fixing part toward the positioning member by an energizing member.

Preferably, an image bearing member unit is constructed by at least the image bearing member and the drive roller. The image bearing member unit is a detachable intermediate transfer unit having an intermediate transfer belt, on which toner images of plural colors are multilayer-transferred from a image carrying member on which the toner image developed from a latent image by a developing unit is formed.

According to the invention, the image forming apparatus of the invention, which includes the belt-shaped image bearing member that lays around the drive roller and rotation-drives the image bearing member, and which forms the toner image on the image bearing member, and thereafter transfers the toner image on a recording medium to form the image. The drive transmitting gear is arranged on the body frame side so that the direction of the drive reaction force of the drive transmitting gear which transmits the drive power to the drive gear applying onto the drive gear coincides with the ingress direction of the image bearing member. The drive transmitting gear is arranged so that the line connecting the drive gear axis of the drive roller and the drive transmitting gear axis which transmits the drive to the drive gear is nearly perpendicular to the direction of the longitudinal axis of the image bearing member unit. Therefore, in spite of the load variation of the image bearing member, it is possible to prevent the drive gear from sinking, and to prevent the speed of the belt from changing.

The image bearing member has the cleaning member for cleaning the image bearing member. The cleaning member is separatably abutted on the image bearing member, whereby it can deal with the load variation due to separation and contact of the cleaning member, and can prevent lowering of the cleaning property without decreasing the energizing power.

Since the positioning member for positioning the drive gear of the drive roller is arranged on the body frame, being brought into contact with the bearing portion of the drive gear. Therefore, sink of the drive gear can be eliminated in spite of the load variation of the image bearing member.

The positioning member has the contact face opposed to the ingress direction of the image bearing member, and is the concave member, with which the bearing part comes into contact at a bottom and both side faces, into which the bearing part fits, from which the bearing portion can be detached upward. Therefore, the positioning member can readily perform the upward detachment and positioning, and can effectively oppose its face in the direction of the drive reaction force thereby to exactly position the bearing portion in the both side direction and in the up-down direction. Further, the positioning member fixes the rotary shaft of the drive transmitting gear thereby to regulate the shaft distance between the contact face and the bearing portion of the drive gear. Therefore, the shaft distance between the drive transmitting gear on the body frame side and the drive gear of the image bearing member unit can be exactly kept, positional variation of the gear engaging part can be removed, and damage of the gear can be prevented thereby to prolong a life of the gear.

The image bearing member has the plurality of screwed fixing parts (for example, four screwed fixing parts) fixed to the image forming apparatus body frame, and of the screwed fixing parts, the fixing part close to the bearing portion of the drive gear is energized on the positioning member side by the energizing member and fixed, whereby interference between the fixing part and the positioning member can be prevented, and the load onto the unit frame by fixing can be eliminated. The image bearing member is the detachable intermediate transfer unit having the intermediate transfer belt, on which the toner images of the plural colors are multilayer-transferred from the image bearing member on which the toner image formed by developing the latent image by the developing unit is formed. Hereby, even during the transferring operation, the contact and separation of the cleaning member can be controlled thereby to start cleaning of the residual toner in the image region where the transfer has been completed, the next image formation can be continuously performed, and speed-up of the image formation can be realized.

As described above, according to the invention, since the conditions of the cleaning member are not Ranged, the cleaning property does not lower, and by addition of only the simple resin member, the cleaning member can be realized. Therefore, since the increase of weight and the increase of cost can be suppressed to a minimum, and there is no positional variation of the gear engaging part, the damage of the gear, and the damage due to looseness of the engagement can be prevented, so that a good image which does not causes color registration error is obtained.

According to the present invention, there is also provided an image forming apparatus, comprising:

an image bearing member, on which a toner image is formed, and the image bearing member having an endless belt shape;

a drive roller, which rotates the image bearing member laid around the drive roller, a drive gear;

a connecting member, which connects the drive roller and the drive gear;

a drive transmitting gear, which is engaged with the drive gear, and transmits a driving force to the drive gear to rotate the image bearing member; and a positioning member, which is abutted on a part of the connecting member for receiving a drive reaction force of the drive transmitting gear with respect to the drive gear.

Preferably, the part of the connecting member is a bearing portion of the drive gear.

Preferably the positioning member has at least one contact face opposed to an ingress direction of the image bearing member toward the drive roller.

Preferably, an image bearing member unit is constructed by at least the image bearing member and the drive roller. The positioning member has at least one contact face opposed to an attachment and detachment direction of the image bearing member unit.

Preferably, the positioning member has at least two contact faces which receive components of the drive reaction force.

Preferably, the positioning member is a concave member having a bottom face and both side faces. The bearing portion is abutted on the bottom face and the both side faces when the bearing portion is fitted into the concave member. The concave member allows to detach the bearing portion therefrom upward.

Preferably, the positioning member fixes a rotary shaft of the drive transmitting gear to regulate a distance between the rotary shaft of the drive transmitting gear and a rotary shaft of the drive gear.

The image forming apparatus further includes a cleaning member which is separatably abutted on the image bearing member to clean the image bearing member.

Preferably, an image bearing member unit is constructed by at least the image bearing member and the drive roller. The image bearing member unit further includes a plurality of fixing parts which are fixed to an image forming apparatus body frame. At least one fixing part close to the connecting member of the drive gear in the fixing parts is fixed while energizing the fixing part toward the positioning member by an energizing member.

Preferably, the drive gear and the drive transmitting gear are arranged so that a drive reaction force of the drive transmitting gear with respect to the drive gear has a component of the force in an ingress direction of the image bearing member toward the drive roller.

Preferably, an image bearing member unit is constructed by at east the image bearing member and the drive roller. The image bearing member unit is a detachable intermediate transfer unit having an intermediate transfer belt, on which toner images of plural colors are multilayer-transferred from a image carrying member on which the toner image developed from a latent image by a developing unit is formed.

According to the invention, in the image forming apparatus of the invention, which includes the image bearing member that lays around the drive roller and the winding member and rotation-drives the image bearing member, and which forms the toner image on the image bearing member, and thereafter transfers the toner image on the recording medium to form the image, the positioning member for positioning the drive gear of the drive roller is fixed to an image forming apparatus body frame, and the positioning member is brought into contact with the bearing portion of the drive gear thereby to receive the drive reaction force from the drive transmitting gear on the image forming apparatus body frame side. Therefore, in spite of load variation of the belt, it is possible to prevent the drive gear from sinking, and to perform the exact positioning in the up-down direction.

The positioning member has at least one contact face opposed to the ingress direction of the image bearing member to the drive gear, the contact face opposed to the attachment and detachment direction of the image bearing member, or two contact faces which receive components of the drive reaction force. Further, the positioning member is the concave member with which the bearing part comes into contact at the bottom and both sides faces, into which the bearing portion fits, and from which the bearing portion can be detached upward. Therefore, by opposing the contact face effectively in the direction of the drive reaction force, the bearing portion can be exactly positioned in the left and both side direction and in the up-down direction. Further, the rotary shaft of the drive transmitting gear is fixed to the positioning member thereby to regulate the shaft distance between the contact face and the bearing portion of the drive gear. Therefore, the shaft distance between the drive transmitting gear on the body frame side and the drive gear of the image bearing member can be exactly kept positional variation of the gear engaging part can be removed, and damage of the gear can be prevented thereby to prolong a life of the gear.

The image bearing member has the cleaning member as the separation and contact member for cleaning the image bearing member, whereby it can deal with the load variation due to separation and contact of the cleaning member, and can prevent lowering of the cleaning property without decreasing the energizing power. Even during the transferring operation, the separation and contact of the cleaning member can be controlled, cleaning of the residual toner in the image region where the transfer has been completed can be started, the next image formation can be continuously performed, and speed-up of the image formation can be realized.

The bearing member unit has the screwed fixing parts fixed to the image forming apparatus body frame, and of the screwed fixing parts, at least one fixing part close to the bearing part of the drive gear is energized to the positioning member by the energizing member and fixed, whereby interference between the fixing part and the positioning member can be prevented, and the load onto the unit frame by fixing can be eliminated.

in the image bearing member unit, the drive gear engages with the drive transmitting gear in such a positional relation that the direction of the drive reaction force has component of the force in the ingress direction of the image bearing member, whereby the drive reaction force can be canceled.

The image bearing member unit can be applied to the detachable intermediate transfer unit having the intermediate transfer belt, on which the toner images of the plural colors are multilayer-transferred from the image bearing member on which the toner image formed by developing the latent image by the developing unit is formed. Hereby, even during transferring the toner image firstly onto the image bearing member, cleaning of the residual toner in the image region where the second bias transfer has been completed can be started, the next image formation can be continuously performed, and speed-up of the image formation can be realized.

As described above, according to the invention, since the conditions of the cleaning member are not changed, the cleaning property does not lower, and by addition of only the simple resin member, the cleaner blade can be realized. Therefore, since the increase of weight and the increase of cost can be suppressed to a minimum, and there is no positional variation of the gear engaging part, the damage of the gear, and the damage due to looseness of the engagement can be prevented, so that a good image which does not causes color registration error is obtained.

BRIEF DESCRIPTION OF THE DRAWINGS

The above objects and advantages of the present invention will become more apparent by describing in detail preferred exemplary embodiments thereof with reference to the accompanying drawings, wherein.

DETAILED DESCRIPTION OF THE PREFERRED EMBODIMENTS

Figure 1:
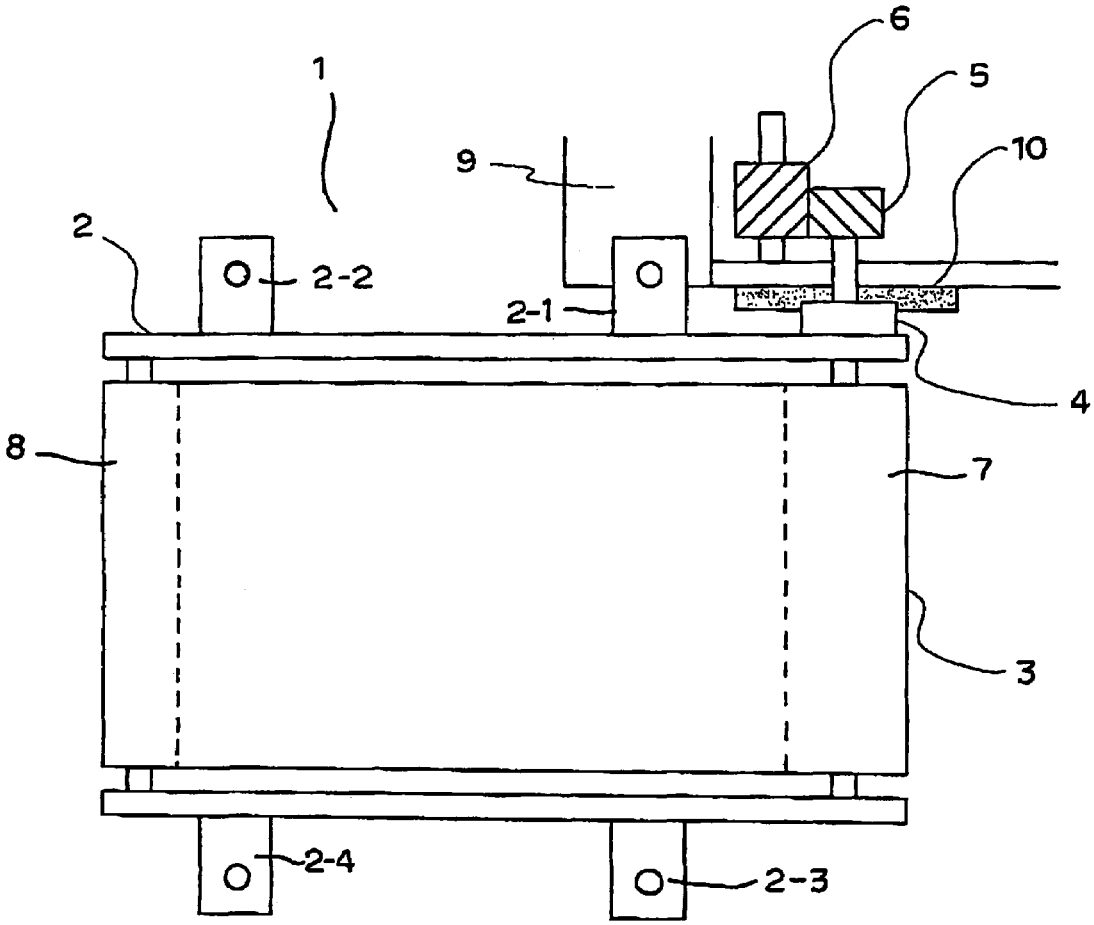
FIG. 1 is a diagram for explaining an embodiment of an image forming apparatus according to the invention.
Figure 2:
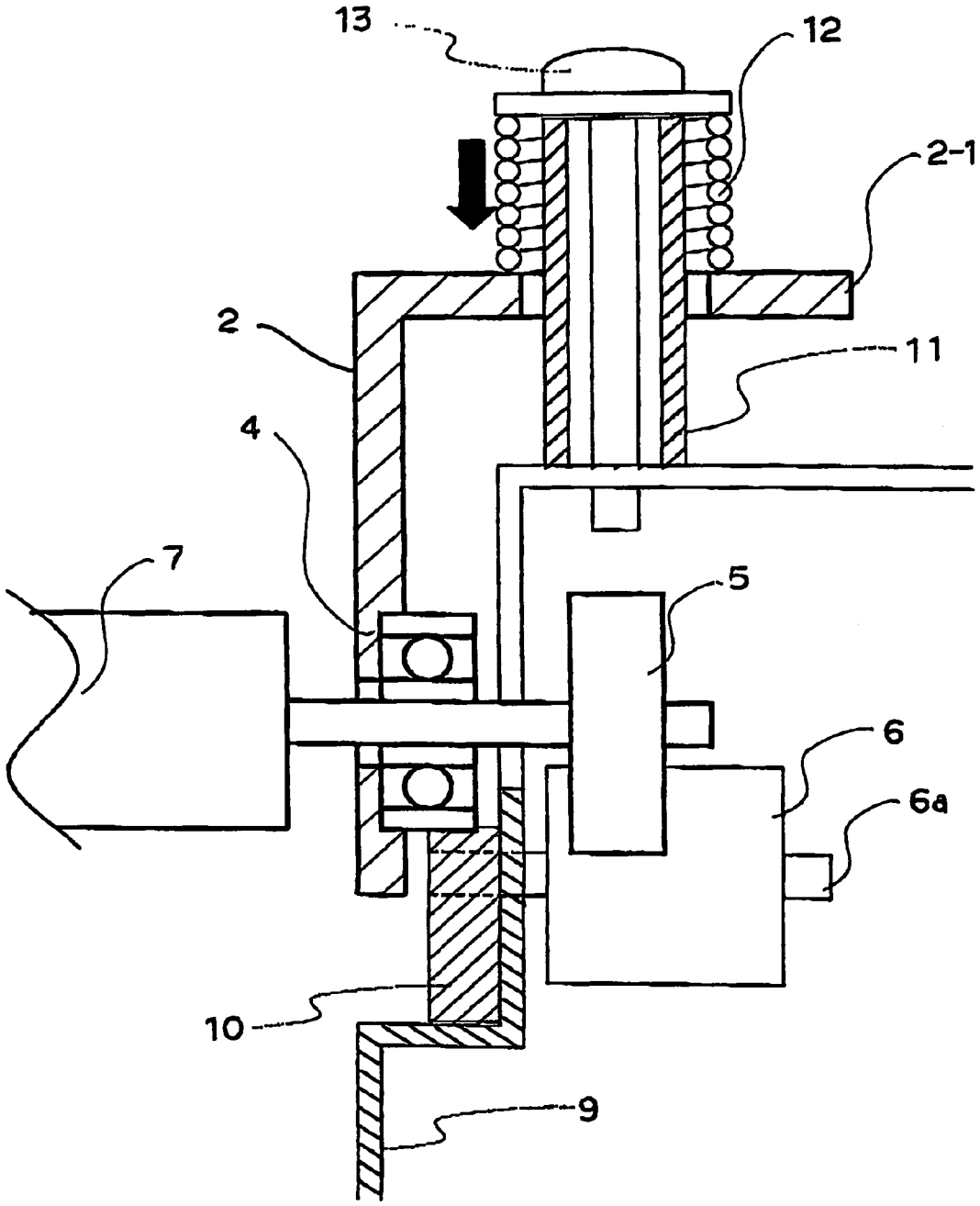
FIG. 2 is a diagram showing a side section of a positioning part of an intermediate transfer unit to a body frame.

With reference to drawings, an embodiment of the invention will be described below. FIG. 1 is a diagram for explaining the embodiment of an image forming apparatus according to the invention, and FIG. 2 is a diagram showing a side section of a positioning part of an intermediate transfer unit to a body frame. In the figures, reference numeral 1 is an intermediate transfer unit, 2 is a unit frame, 2-1 to 2-4 are fixing legs, 3 is an intermediate transfer belt, 4 is a bearing, 5 is a drive gear, 6 is a drive transmitting gear, 7 is a drive roller, 8 is back up roller, 9 is a body frame, 10 is a positioning member, 11 is a bush, 12 is an energizing spring, 13 is a locking screw, and 14 is a cleaner blade.

in FIG. 1, the intermediate transfer unit i has the unit frame 2 which is formed both sides of the intermediate transfer belt 3 that is an image bearing member having an endless shaped belt, and the four going legs 2-1 to 2-4 protruding from the unit frame 2 are screwed to the body frame 9. The unit frame 2 is removable from the body frame 9 and exchangeable. The intermediate transfer belt 3 is laid around the drive roller 7, the driven roller 8, a transfer roller, and a tension roller which are attached to the unit frame 2, and a photoconductor comes into contact with the intermediate transfer belt 3 in a transfer position opposed to the transfer roller.

The bearing 4 and the drive gear 6 are attached to one end of a rotary shaft of the drive roller 7. The bearing 4 is positioned by the positioning member 10 attached to the body frame 9, and the drive gear 5 engages with the drive transmitting gear 6. By a drive motor attached to the body frame 9, the drive gear 5 is driven through the drive transmitting gear 6, and the endless intermediate transfer belt 3 is rotated and transported by the drive roller 7 rotating integrally with the drive gear S.

When the intermediate transfer unit 1 is directly screwed to the body frame 9 at the four fixing legs 2-1 to 2-4 protruding from the unit frame 2, positional adjustment between the unit 1 and the positioning member 10 is difficult. Therefore, as shown in FIG. 2, of the four fixing legs 2-1 to 2-4, the fixing leg 2-1 closest to the drive roller 7, that is, the fixing leg 2-1 closest to the positioning member 10 is caused to come up from the body frame 9. The fixing leg 2-1 coming up from the body frame 9 is screwed to the body frame 9 and energized, using the locking screw 13, the bush 11, and the energizing spring 12. Hereby, fixing leg 2-1 is pressed against the body frame 9 with the constant power. Opposed to the energizing direction of this spring, the positioning member 10 and the drive transmitting gear 6 are attached integrally to the body frame 9, and the positioning member 10 receives the bearing 4 of the rotary shaft of the drive gear 5.

Accordingly, the bearing 4 is energized so as to come always into contact with the positioning member 10, and positioned. Addition of such the positioning member 10 causes interference between the fixing part 2-1 of the unit frame 2 closest to the positioning member 10 and the positioning member 10. However, since the fixing leg 2-1 is caused to come up and the energizing spring 12 is provided, the load onto the unit frame by fixing of the intermediate transfer unit 1 is eliminated.

Figure 3:
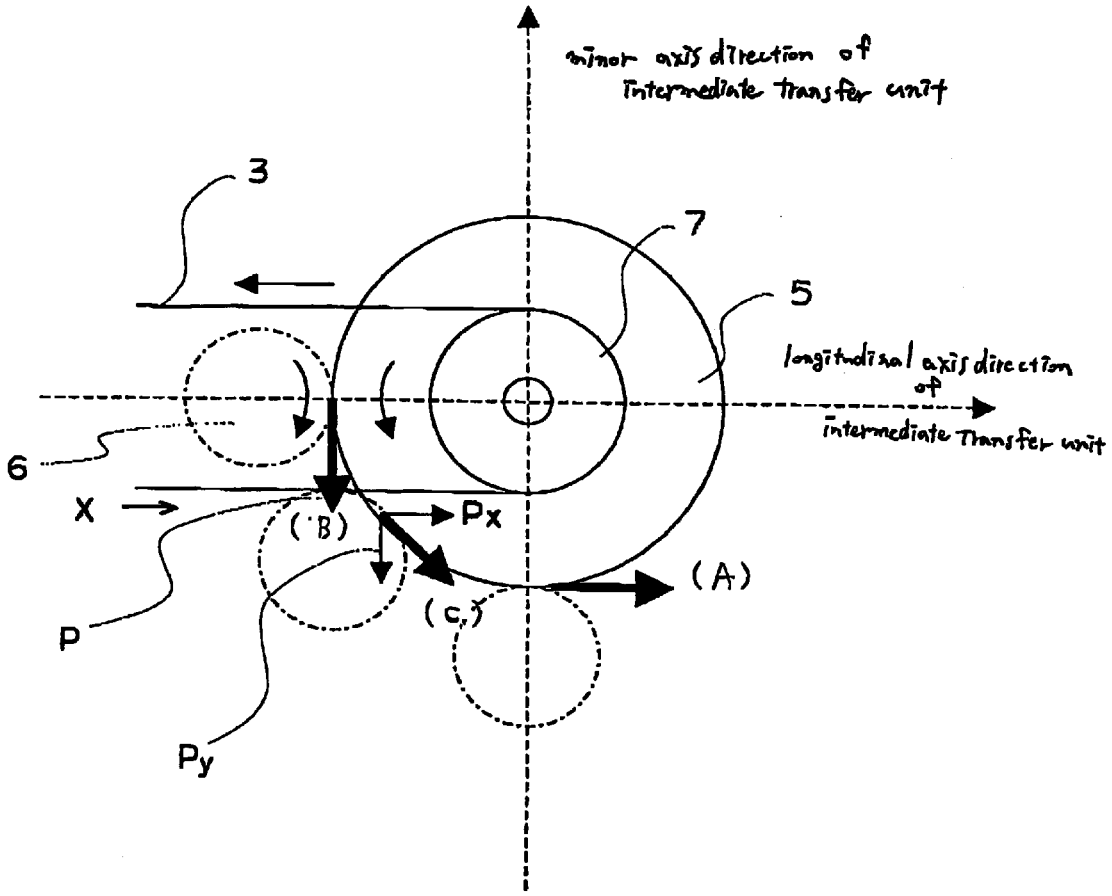
FIG. 3 is a diagram for explaining a relation between drive reaction force produced with the sudden change of the load onto the intermediate transfer belt and a position of a drive transmitting gear.
Figure 4:
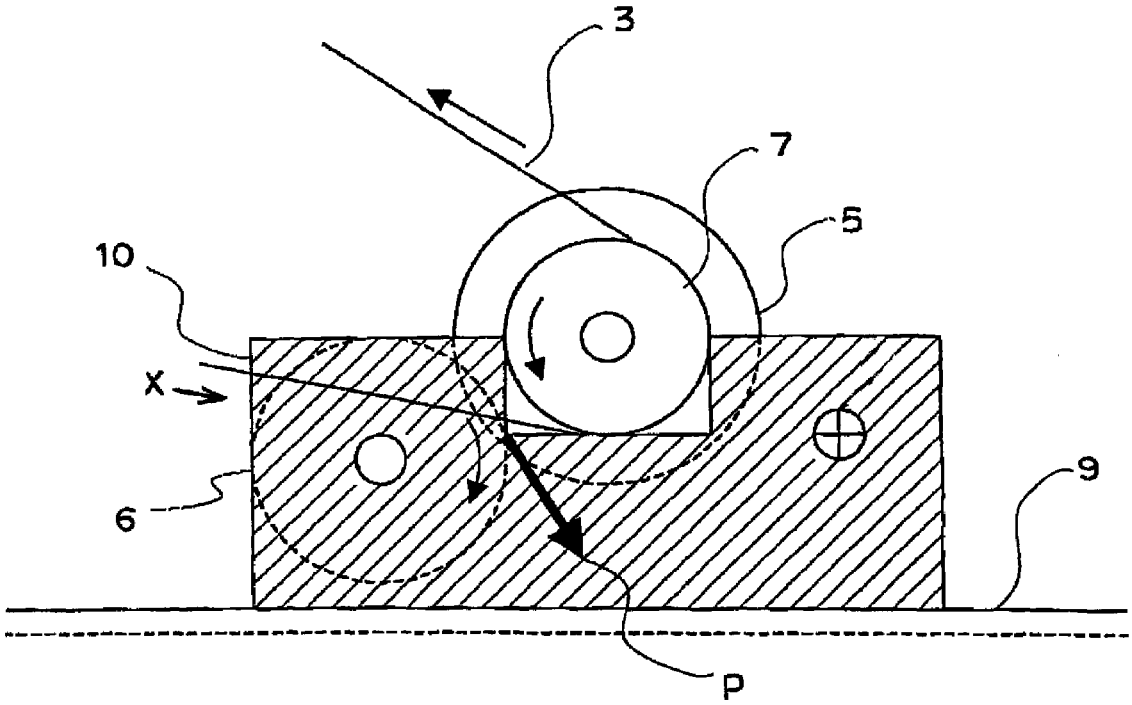
FIG. 4 is a diagram for explaining a relation between the drive reaction force produced with the sudden change of the load onto the intermediate transfer belt, and a face regulated by the positioning member.

FIG. 3 is a diagram for explaining a relation between drive reaction formed produced with the sudden change of the load onto the intermediate transfer belt, and the position of the drive transmitting gear, and FIG. 4 is a diagram for explaining a relation between the drive reaction force produced with the sudden change of the load onto the intermediate transfer belt, and a regulated face by the positioning member.

Figure 5:
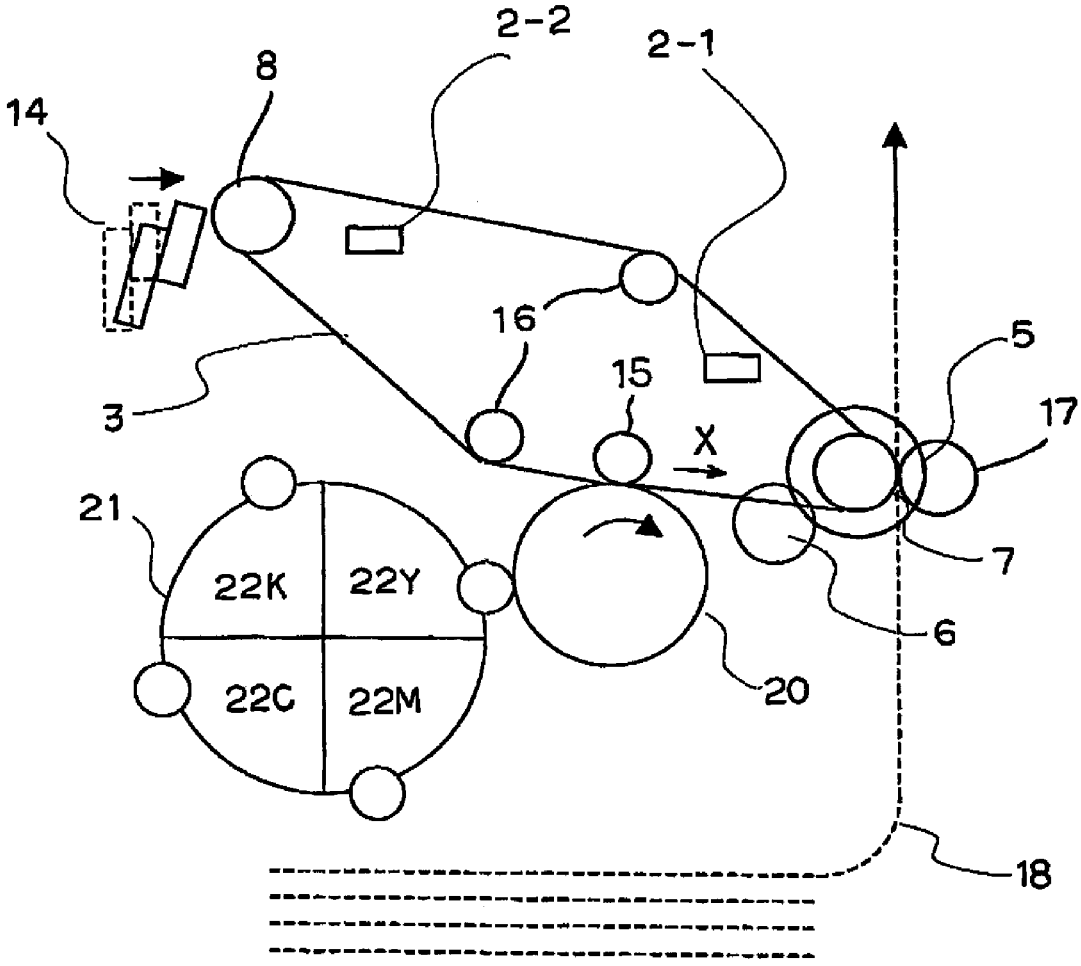
FIG. 5 is a diagram showing outlines of the constitution of a full-color image forming apparatus.

As described in the above by using FIG. 5 in the color image forming apparatus having the rotary development device 21 provided with the developing units 22 of four colors, firstly, a face of the photoconductor 20 is uniformly charged, and thereafter a laser beam is scanned according to an image signal of a first color thereby to form a latent image on the photoconductor. Next, the latent image formed on the photoconductor 20 is developed by the developing unit 22 of the first color, and its toner image is transferred onto the intermediate transfer belt 3 (first transfer. By repeatedly performing a development color switching operation by the rotary development device 21, according to other three color image signals, similarly toner images developed by the developing units 22 of the three colors are in order transferred onto the intermediate transfer belt 3 for multilayer transfer (first transfer), whereby a color image is formed, and a color image formed lastly on the intermediate transfer belt 3 is transferred onto a recording medium (for example, a paper) in the lump (second transfer), and fixed.

The cleaner blade 14 of the transfer belt which scrapes the residual toner on the intermediate transfer belt 3 to perform cleaning is separated from the intermediate transfer belt 3 during the period when the toner images of the respective colors on the photoconductor 20 are in order transferred on the intermediate transfer belt 3 for multilayer transfer of the toner images of the four colors, and its color image is transferred at one time (second transfer). When the color image on the intermediate transfer belt 3 has been transferred at one time onto the recording medium (for example, a paper) (second transfer), the cleaner blade 14 of the transfer belt comes into contact with the intermediate transfer belt 3 in order to clean the residual toner. In order to increase the cleaning property, press power of some degree is provided for the cleaner blade 14 coming into contact with the intermediate transfer belt 3. Therefore, at this time, large load variation is produced sharply in the drive gear 5 which rotates and transports the intermediate transfer belt 3.

Figure 6:
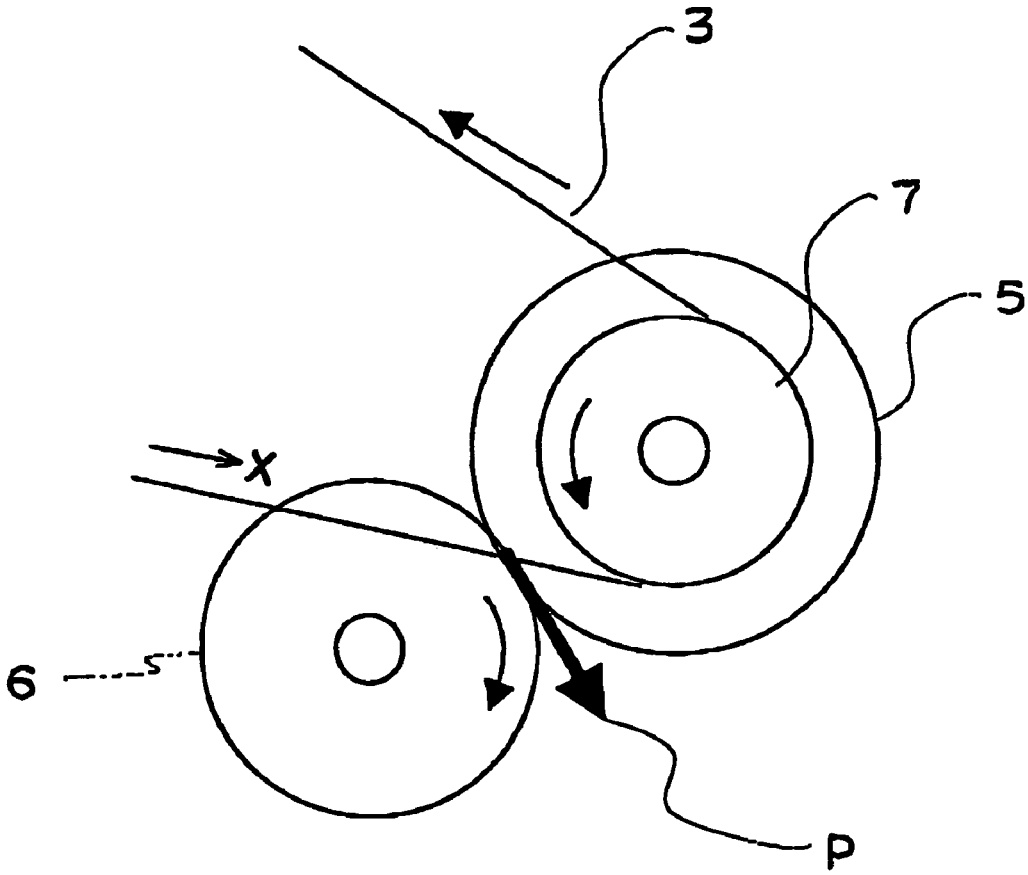
FIG. 6 is a diagram for explaining the drive reaction force and a sink phenomenon which act on a drive gear of a belt-shaped image bearing member unit.
Figure 7:
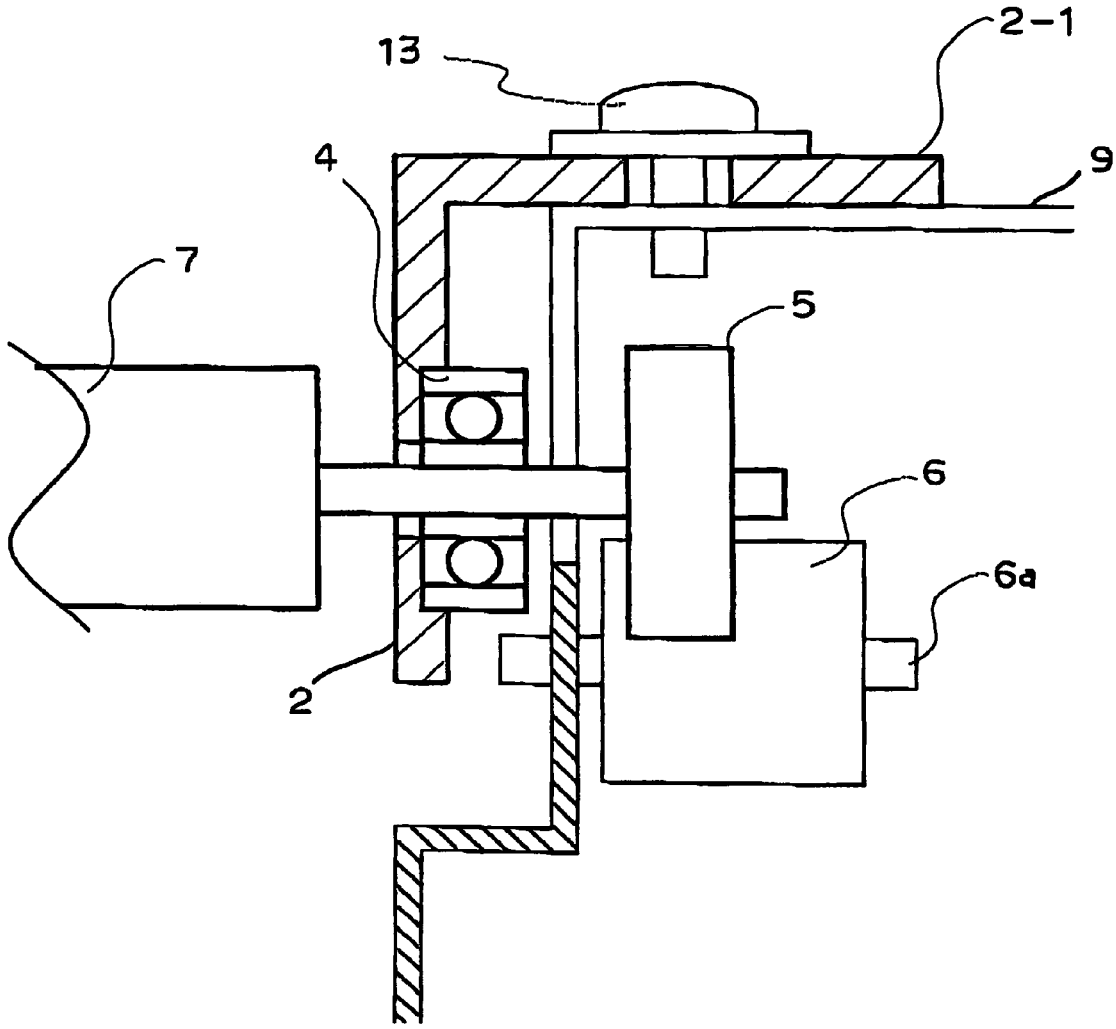
FIG. 7 is a diagram for explaining the attachment structure of the belt-shaped image bearing member unit.

A timing when the deaner blade 14 of the transfer belt comes into contact with the intermediate transfer belt 3 is after the image region in which the toner image of the third color is multilayer transferred has passes. At this time, in the first transfer part, the toner image of the four color is multilayer-transferred from the face of the photoconductor 20 onto the intermediate transfer belt 3. In the second transfer part, the color image formed by multilayer transferring the toner images of the four colors is transferred from the face of the intermediate transfer belt 3 to the recording medium. Therefore, in case, that the transporting speed of the intermediate transfer belt 3 changes during these transferring operations, on the intermediate transfer belt 3, a color registration error is produced between the toner images of the first to third colors and the toner image of the four color to be layered over them, and further an image registration error is produced also in the recording medium.

in case that the load variation is produced in the drive gear 5, as shown in FIG. 6, a strong drive reaction force P acts in the drive direction of the drive transmitting gear 6 along a tangent line of an engaging part between the drive transmitting gear 6 and the drive gear 5. In case that the drive gear 5 does not have a positional regulation member, the drive gear 5 moves in the direction of the drive reaction force P and sinks, whereby the transporting speed of the intermediate transfer belt 3 changes.

However, in a state that the drive transmitting gear 6 is situated at position (A) of FIG. 3, the direction of the tangent line of the engaging part between the drive transmitting gear 6 and the drive gear 5, in which the drive reaction force acts, is matched with an ingress direction X of the intermediate transfer belt 3, or with the same direction as the direction of a longitudinal axis of the intermediate transfer unit 1, in other words, in case that the drive transmitting gear 6 is arranged in a position where a line connecting the axes of the drive gear 5 and the drive transmitting gear 6 is nearly perpendicular to the ingress direction X of the intermediate transfer belt 3, the load variation and the drive reaction force are cancelled, and the sink movement of the drive gear 5 is regulated. Hereby, the change of the transporting speed of the intermediate transfer belt 3 can be suppressed.

In a state that the drive transmitting gear 6 is situated at position (B) of FIG. 3, the direction of the tangent line of the engaging part is matched with a direction orthogonal to the ingress direction X of the intermediate transfer belt 3. The drive reaction force P does not have a component Px of the force in the ingress direction X, therefore, the drive gear 5 is easy to move in the direction of the drive reaction force P. As a result, there is no effect of suppressing the change of the transporting speed of the intermediate transfer belt 3.

On the other hand, in a state that the drive transmitting gear 6 is situated at position (C) of FIG. 3, the drive gear 5 and the drive transmitting gear 6 are arranged in such a positional relation that the drive reaction force P has the component Px of the force in the ingress direction X of the belt-shaped image bearing member 3, and a component Py of the force perpendicular to the ingress direction X, and the drive gear 5 and the drive transmitting gear 6 engage with each other, that is, in case that the drive transmitting gear 6 is arranged along the drive gear 5 on the downside of a line in the longitudinal axis direction of the intermediate transfer unit 1, which passes the rotary shaft of the drive gear 5 in FIG. 3, or along the drive gear 5 on the downside of a line in the ingress direction X of the intermediate transfer belt 3, the force for regulating the sink movement of the drive gear 5 can be caused, which is effective to suppress the change of the transporting speed with the load variation of the intermediate transfer belt 3.

Regarding positioning (positional regulation) by the positioning member 10, shown in FIGS. 1 and 2, the contact face may be provided so as to regulate the movement of the drive gear 5 due to the drive reaction force. As the positioning member 10, a member has contact faces at a bottom, a left and a right of a convex. The convex receives the bearing 4 so as to drop the bearing 4 in from the upside as shown in FIG. 4.

The positioning member 10 is arranged in a positional relation in which the ingress direction of the intermediate transfer belt 3, the direction of the tangent line of the engaging part between the drive transmitting gear 6 and the drive gear 5, and the direction of the drive reaction force impinge on any of these three contact faces. For example, in case that the direction of the tangent line of the engaging part when the drive transmitting gear 6 is situated at a position (B) of FIG. 3, has a direction component which is the downward direction orthogonal to the ingress direction X of the intermediate transfer belt 3, the positioning member 10 is arranged so as to come into contact with at least the downside of the bearing 4.

Further, since the rotary shaft 6*a* of the drive transmission gear 6 is fixed to the positioning member 10, in the fixed position of this rotary shaft 6*a* and under the positioning member 10, by the bottom, left, and fight contact faces of the convex, the shaft distance between the drive transmitting gear 6 and the drive gear 5 can be fixed. Therefore, looseness of engagement can be eliminated, so that the positional variation or damage of the gear due to the looseness of engagement can be prevented. Further, the bearing 4 that is the bearing of the drive roller 7 is shaped so that the left and right directions of the bearing 4 can be positioned, and the positioning member 10 itself is positioned by the body frame 9 and the rotary shaft 6*a* of the drive transmitting gear 6. Therefore, the distance between the shafts of the drive transmitting gear 6 on the body side and the drive gear 5 on the intermediate transfer unit 1 side can be exactly kept. Accordingly, it is possible to prevent the drive gear 5 of the intermediate transfer unit 1 from shifting downward, so that sinking of the gear is eliminated, and the exact positioning in the up-down direction can be performed.

The invention is not limited to the above embodiment, but various modifications can be performed. For example, though positioning of the drive gear of the intermediate transfer unit of the rotary development type image forming apparatus has been described in the above embodiment, as long as the belt-shaped image bearing member unit having the image bearing member composed of the endless belt which is laid around the drive roller, the driven roller, and the tension roller, and drives them is used, the invention may be similarly applied to an image forming apparatus having another constitution. Further, though the invention can deal with the load variation produced when the cleaner blade separates from and contacts with the belt, the invention can be also applied to an apparatus having no member that separates and contacts, as long as its apparatus prevents the drive roller from sinking due to the load variation and prevents the belt peripheral speed from changing.

What is claimed is:

1. An image forming apparatus comprising:

an image bearing member, on which a toner image is formed, and the image bearing member having an endless belt shape;

a drive roller, which rotates the image bearing member laid around the drive roller;

a drive gear, which is connected to the drive roller;

a positioning member which is abutted on a bearing portion of the drive gear for positioning the drive gear of the drive roller; and a drive transmitting gear, which is engaged with the drive gear, and transmits a driving force to the drive gear to rotate the image bearing member, wherein the drive transmitting gear is arranged so that a direction of a drive reaction force of the drive transmitting gear with respect to the drive gear substantially coincides with an ingress direction of the image bearing member toward the drive roller.

2. The image forming apparatus as set forth in claim 1, further comprising a cleaning member which is separatably abutted on the image bearing member to dean the image bearing member.

3. The image forming apparatus as set forth in claim 1, wherein the positioning member has at least one contact face opposed to the ingress direction off the image bearing member.

4. The image forming apparatus as set forth in claim 1, wherein the positioning member is a concave member having a bottom face and both side faces;

wherein the bearing portion is abutted on the bottom face and the both side faces when the bearing portion is fitted into the concave member; and wherein the concave member allows to detach the bearing portion therefrom upward.

5. The image forming apparatus as set forth in claim 1, wherein the positioning member fixes a rotary shaft of the drive transmitting gear to regulate a distance between the rotary shaft of the drive transmitting gear and a rotary shaft of the drive gear.

6. The image forming apparatus as set forth in claim 1, wherein an image bearing member unit is constructed by at least the image bearing member and the drive roller, wherein the image bearing member unit further includes a plurality of fixing parts which are fixed to an image forming apparatus body frame; and wherein at least one fixing part close to a connecting member of the drive gear in the fixing parts is fixed while energizing the fixing part toward the positioning member by an energizing member.

7. The image forming apparatus as set forth in claim 1, wherein an image bearing member unit is constructed by at least the image bearing member and the drive roller; and wherein the image bearing member unit is a detachable intermediate transfer unit having an intermediate transfer belt, on which toner images of plural colors are multilayer-transferred from an image carrying member on which the toner image developed from a latent image by a developing unit is formed.

8. An image forming apparatus, comprising:

an image bearing member, on which a toner image is formed, and the image bearing member having an endless belt shape;

a winding roller;

a drive roller, which rotates the image bearing member laid around the drive roller and the winding roller;

a drive gear, which is connected to the drive roller;

a positioning member which is abutted on a bearing portion of the drive gear for positioning the drive gear of the drive roller; and a drive transmitting gear, which is engaged with the drive gear, and transmits a driving force to the drive gear to rotate the image bearing member;

wherein the drive transmitting gear is arranged so that a line connecting axes of the drive transmitting gear and the drive gear is substantially perpendicular to a line connecting axes of the drive roller and the winding roller.

9. An image forming apparatus, comprising:

an image bearing member, on which a toner image is formed, and the image bearing member having an endless belt shape;

a drive roller, which rotates the image bearing member laid around the drive roller;

a drive gear;

a connecting member, which connects the drive roller and the drive gear;

a drive transmitting gear, which is engaged with the drive gear, and transmits a driving force to the drive gear to rotate the image bearing member; and a positioning member, which is abutted on a part of the connecting member for receiving a drive reaction force of the drive transmitting gear with respect to the drive gear.

10. The image forming apparatus as set forth in claim 9, wherein the part of the connecting member is a bearing portion of the drive gear.

11. The image forming apparatus as set forth in claim 10, wherein the positioning member is a concave member having a bottom face and both side faces;

wherein the bearing portion is abutted on the bottom face and the both side faces when the bearing portion is fitted into the concave member; and wherein the concave member allows to detach the bearing portion therefrom upward.

12. The image forming apparatus as set forth in claim 9, wherein the positioning member has at least one contact face opposed to an ingress direction of the image bearing member toward the drive roller.

13. The image forming apparatus as set forth in claim 9, wherein an image bearing member unit is constructed by at least the image bearing member and the drive roller; and wherein the positioning member has at least one contact face opposed to an attachment and detachment direction of the image bearing member unit.

14. The image forming apparatus as set forth in claim 9, wherein the positioning member has at least two contact faces which receive components of the drive reaction force.

15. The image forming apparatus as set forth in claim 9, wherein the positioning member fixes a rotary shaft of the drive transmitting gear to regulate a distance between the rotary shaft of the drive transmitting gear and a rotary shaft of the drive gear.

16. The image forming apparatus as set forth in claim 9, further comprising a cleaning member which is separatably abutted on the image bearing member to clean the image bearing member.

17. The image forming apparatus as set forth in claim 9, wherein an image bearing member unit is constructed by at least the image bearing member and the drive roller;

wherein the image bearing member unit further includes a plurality of fixing parts which are fixed to an image forming apparatus body frame; and wherein at least one fixing part close to the connecting member of the drive gear in the fixing parts is fixed while energizing the fixing part toward the positioning member by an energizing member.

18. The image forming apparatus as set forth in claim 9, wherein the drive gear and the drive transmitting gear are arranged so that a drive reaction force of the drive transmitting gear with respect to the drive gear has a component of the force in an ingress direction of the image bearing member toward the drive roller.

19. The image forming apparatus as set forth in claim 9, wherein an image bearing member unit is constructed by at least the image bearing member and the drive roller; and wherein the image bearing member unit is a detachable intermediate transfer unit having an intermediate transfer belt, on which toner images of plural colors are multilayer-transferred from an image carrying member on which the toner image developed from a latent image by a developing unit is formed.

* * * * *